US008720680B2

(12) United States Patent
Casey

(10) Patent No.: US 8,720,680 B2
(45) **Date of Patent: *May 13, 2014**

(54) SYSTEM AND METHOD FOR STORING AND MIXING TWO OR MORE SUBSTANCES

(75) Inventor: Theodore Casey, Dallas, TX (US)

(73) Assignee: DryBev International, Inc., Charlestown, Nevis (KN)

( * ) Notice: Subject to any disclaimer, the term of this patent is extended or adjusted under 35 U.S.C. 154(b) by 0 days.

This patent is subject to a terminal disclaimer.

(21) Appl. No.: 12/955,652

(22) Filed: Nov. 29, 2010

(65) Prior Publication Data

US 2011/0290679 A1 Dec. 1, 2011

Related U.S. Application Data

(63) Continuation of application No. 11/851,991, filed on Sep. 7, 2007, now Pat. No. 7,861,855.

(51) Int. Cl.
*B65D 25/08* (2006.01)
*B65B 21/06* (2006.01)

(52) U.S. Cl.
USPC ..... 206/221; 53/443

(58) Field of Classification Search
USPC ..... 206/219–222, 568; 222/80–83, 129, 222/129.1–129.6; 53/420, 443, 445, 474, 53/485; 215/DIG. 8
See application file for complete search history.

(56) References Cited

U.S. PATENT DOCUMENTS

| | | | | |
|---|---|---|---|---|
| 5,950,819 | A * | 9/1999 | Sellars | 206/221 |
| 5,984,141 | A * | 11/1999 | Gibler | 222/80 |
| 6,527,110 | B2 * | 3/2003 | Moscovitz | 206/222 |
| 7,055,685 | B1 * | 6/2006 | Patterson et al. | 206/220 |
| 7,523,823 | B1 * | 4/2009 | Bednar | 206/222 |
| 7,588,142 | B1 * | 9/2009 | Bush | 206/221 |
| 2004/0149599 | A1 * | 8/2004 | Cho | 206/219 |
| 2007/0227919 | A1 * | 10/2007 | True | 206/219 |
| 2008/0156674 | A1 * | 7/2008 | Correale et al. | 206/221 |
| 2008/0202950 | A1 * | 8/2008 | Anderson | 206/219 |

* cited by examiner

*Primary Examiner* — Luan K Bui
(74) *Attorney, Agent, or Firm* — Casey Griffith; Klemchuk Kubasta LLP

(57) ABSTRACT

A container system for separately storing and mixing two or more substances. The container system is comprised of a main container for holding at least one first substance and a cup for holding at least one second substance, the cup being removably mounted on the neck of the main container such that at least a portion of the cup is suspended within the main container. The cup has an upper portion, a lower portion, and one or more aims for connecting the upper and lower portions. Apertures are formed between the upper and lower portions of the cup such that the contents of the cup may mix with the contents of the main container following removal of an inner cap attached to the cup, and agitation of the main container. The cup and neck are sized to provide a void therebetween, thereby also permitting the substances to mix.

21 Claims, 9 Drawing Sheets

SYSTEM AND METHOD FOR STORING AND MIXING TWO OR MORE SUBSTANCES

CROSS-REFERENCE TO RELATED APPLICATION

This application is a continuation of copending U.S. patent application Ser. No. 11/851,991 for "System and Method for Storing and Mixing Two or More Substances," filed Sep. 7, 2007, U.S. Pat. No. 7,861,855, which is hereby incorporated by reference, and claims priority and the benefit under 35 U.S.C. §120.

FIELD OF THE INVENTION

The present invention relates to containers, and more particularly, the present invention relates to a system and method for separately storing and mixing two or more substances.

DESCRIPTION OF THE RELATED ART

It is often necessary to keep two or more substances separate until it is time for them to be mixed and used for their intended purpose. This is necessary because many substances configured to be mixed with one another begin to quickly degrade after being mixed. For example, many sulphur containing substances such as amino acids, protein mixtures, creatine mixtures, flavoring mixtures, and sweeteners begin to quickly degrade when in the presence of other substances with which they react. Other substances, such as coffee and tea, are commonly stored and shipped in dehydrated form and therefore must be also protected from the introduction of moisture into their respective containers.

Although two substances intended for mixture may each be separately transported and stored in different containers, the end user may find it more convenient if both substances are stored in the same container system. Users may also find it convenient if the container system provides a means for easily mixing the substances.

The prior art reveals various container systems configured to separately store two substances and provide a means for mixing said substances. Many prior art container systems utilize dual containers as a means for segregating the substances. However, the means by which the substances are mixed varies considerably within the prior art. For example, U.S. Pat. No. 6,059,443 to Casey ("the '443 patent") discloses a container system having a main body configured to contain a liquid, and a storage repository containing a mixing substance, said storage repository is sized to fit in the neck of said main body. The storage repository is supported within the neck of the main body by a plurality of support arms. A threaded cap is fastened to threads formed on the outer surface of the neck of the main body such that a water-tight seal is formed therebetween. When fastened, a void is formed between the lip of the neck of the main body and the top inner surface of the cap. In order to mix the substances stored within the main body and the storage repository, the cap and a removable seal fastened to the lip of the neck of the main body must be removed, and the cap refastened. Vortices generated by the liquid mix with the mixing substance within the void between the cap and the lip of the neck. One drawback of the embodiment disclosed in the '443 patent is that once the removable seal has been removed and the cap is refastened to the neck, the cap must maintain a water-tight seal with the neck of the main body. Maintaining the water-tight seal has proven to be problematic as the threads of the cap and the neck must provide said seal.

Another container system which utilizes two containers is disclosed in U.S. Pat. No. 5,114,011 to Robbins, III ("the '011 patent"). The '011 patent discloses a container assembly which is comprised of a main container body configured to hold a liquid, and a cup configured to hold a liquid or a powder. The cup and its contents are detachably supported within the neck of the main container body. After a cap is removed from the neck of the main container body, the cup is removed by the user and a seal is removed from said cup. The contents of the cup are then poured by the user into the main container body and shaken until the desired level of mixing has occurred. The cup is then inverted and fastened to the main container body to be used as a dispenser. A drawback of this design is that it requires a user to physically pour the contents of the cup into the main container body Therefore, a need exists for a container system capable of separately containing two or more substances and provides a user with a means for easily mixing said separated substances.

SUMMARY OF THE INVENTION

Accordingly, there is provided herein, a container system that, in its preferred embodiments, is capable of separately storing two or more substances and is configured to provide a means by which the separated substances may be easily mixed.

In one aspect of the invention the container system comprises a main container for holding one or more substances, and a cup for holding one or more other substances. The main container includes a neck having an outer surface adapted for securing an outer cap thereon, and a lip which defines an upper opening of said main container. The cup comprises an upper portion, a lower portion, and support arms for connecting the upper and lower portions. The upper portion of the cup is supported on a shoulder formed adjacent to the lip on the inner surface of the neck. The lower portion of the cup is suspended within the main container. An inner cap seals the cup, preventing premature mixing of the segregated substances. Once the inner cap is removed and the outer cap securely fastened to the neck, the main container may be inverted and shaken, thus allowing the contents of the cup to escape said cup by moving through apertures between the upper and lower portions of the cup. The cup and neck are sized to provide a void between the neck of the main container and all parts of the cup except for the upper portion. The presence of the void, as well as the apertures, allow the contents of the main container to mix with the contents of the cup following removal of the inner cap, and inversion and agitation of the main container.

In another aspect of the invention, a removable liner is attached to the lip of the main container in order to provide additional means for sealing the main container and cup, thus preventing unwanted leakage of the substances contained therein.

In yet another aspect of the invention, the container system may be shipped, stored, and presented to the consumer in a partitioned packaging system. The packaging system is partitioned such that at least one compartment of the packaging system holds at least a main container body and an outer cap, and a plurality of other compartments each hold a sealed individual cup containing one or more substances ready for mixing. By packaging the container system in this manner, a user may utilize the container system to mix the contents of the plurality of cups packaged with said main container, thus allowing said user to realize a cost savings as it will not be necessary for said user to purchase are entire container system each time they wish to partake of the substances to be mixed.

BRIEF DESCRIPTION OF THE DRAWINGS

The features of the present invention can be more readily understood from the following detailed description with reference to the accompanying drawings wherein.

Preferred embodiments of the container system according to the present invention will now be described in detail with reference to the accompanying drawings.

DETAILED DESCRIPTION OF THE PREFERRED EMBODIMENTS

Figure 1:
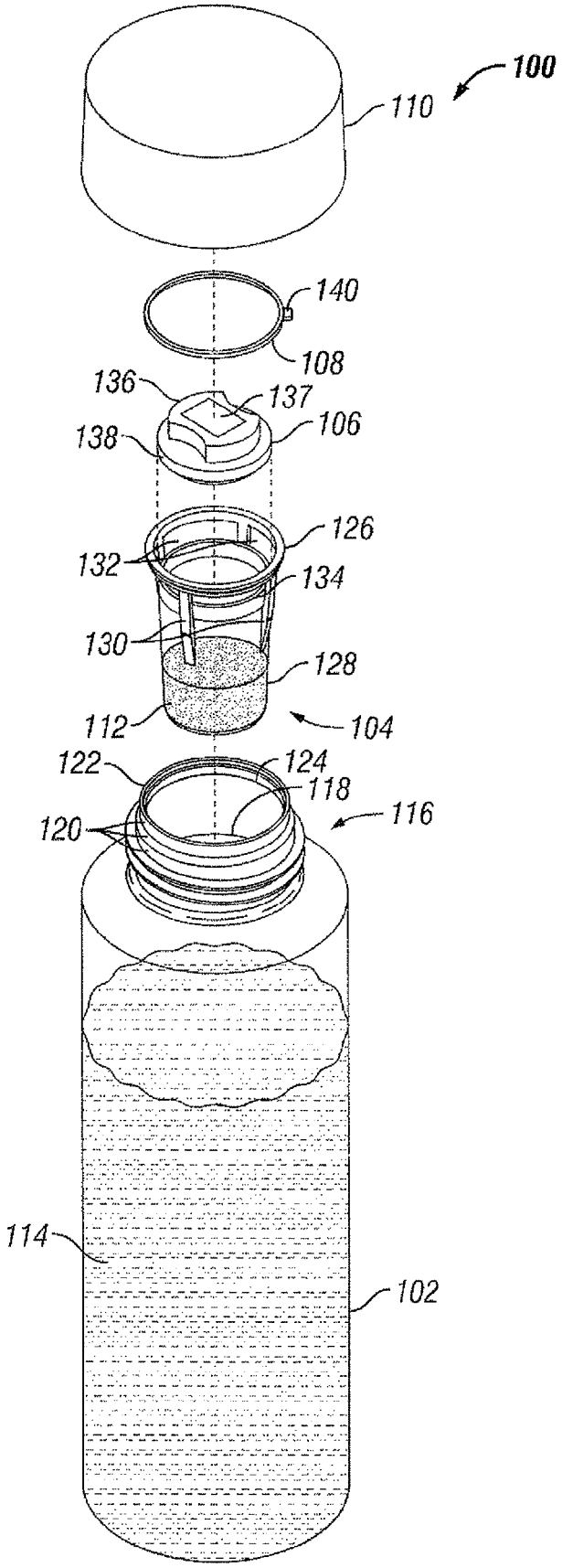
FIG. 1 is an exploded perspective view of a preferred embodiment of the container system of the present invention.

Referring to FIG. 1, an exploded perspective view of a preferred embodiment of the container system 100 of the present invention. The container system 100 is comprised of a main container 102, a cup 104, an inner cap 106, a removable liner 108, and an outer cap 110. The cup 104 contains at least one first substance 112 suitable for mixing with at least one of a second substance 114 contained in said main container 102. All manner of liquid and solid substances are contemplated with respect to the first and second substances including, by way of example and not of limitation, the following substances: protein mixtures, amino-acids, creatine, dietary supplement mixtures, nutritional mixtures, water, tea, coffee, as well as any other substances which may be consumed by a user either alone, or in combination with any other substance. The container system 100 has been configured to allow a user to mix the first substance 112 of the cup with the second substance 114 of the main container body 102 without the necessity of removing the cup 104 from the main container 102. It should be noted that both the main container 102 and the cup 104 are each adapted to hold combinations of substances.

The main container 102 includes a neck 116 with an opening 118 formed on the upper end of said neck 116. Threads 120 are formed on the outer surface of said neck 116, said threads 120 being configured to receive a correspondingly threaded surface (not shown) formed on the inner surface of said outer cap 110. A lip 122 is formed at the opening 118 of the neck 116. The main container 102 may be constructed of any material suitable for storing liquid or solid substances. For example, materials such as plastic, glass, metal, styrofoam and the like may be used to construct said main container 102. It is contemplated that alternate embodiments of the container system 100 may be constructed of materials suitable for heating within a microwave oven or other heating apparatus. It should be noted that the first substance 112 and the second substance 114 may each be in solid form, liquid form, or some combination thereof.

The cup 104 includes an upper portion 126 which is connected to a lower portion 128. The upper portion 126 of the cup 104 rests on a shoulder 124 formed below or flush with the lip 122 on the inner surface of the neck 116. The upper portion 126 of the cup 104 is connected to the lower portion 128 of the cup by at least one arm 130 such that at least one aperture 132 exists between said upper portion 126 and said lower portion 128 of the cup 104. Although a plurality of arms 130 are utilized in connecting the upper 126 and lower portion 128 of the presently preferred embodiment of the cup 104, alternate embodiments of the cup 104 may include any means for connecting said upper portion 126 and said lower portion 128, provided that substantially sized apertures 132 remain between the said upper portion 126 and lower portion 128 such that the contents 112 of the cup 104 may escape during the mixing process and the contents 114 of the main container body 102 may also enter said cup 104 during said mixing process. A second lip 134 is formed on the lower portion 128 of the cup 104. The second lip 134 defines an opening having a diameter smaller in size than the diameter of the upper portion 126 of the cup 104. However, alternate embodiments of the cup 104 may include a second lip 134 having a diameter equal or greater that that of the upper portion 126 of the cup 104.

The presently preferred embodiment of the cup 104 is constructed of High Density Polyethylene (HDPE). However, those skilled in the art will appreciate that other materials such as polymers and metals may possess properties sufficiently suitable for use in constructing the cup 104 of alternate embodiments of the invention.

The inner cap 106 is configured to attach to the lip 134 of the lower portion 128 of the cup 104 during shipping and storage of the container system 100. The inner cap 106 includes a top end 136 and a bottom end 138. The bottom end 138 of the inner cap 106 is configured such that it may be secured to the lip 134 of the lower portion of the cup 128, thus preventing the contents of the cup 112 from prematurely mixing with the contents of the main container 114. The top end 136 of the inner cap 106 may include a means for gripping the cap, thus allowing the user to easily remove the inner cap 106 from the cup 104. Furthermore, at least a portion 137 of the top end 136 of the presently preferred embodiment of the cup 104 is constructed of polypropylene, thus providing a surface which may be more easily adhered to by the removable liner 108. It is contemplated that the removable liner 108 will adhere to the portion 137 of the inner cap 106 which is constructed of polypropylene such that when said liner 108 is removed by the user, the inner cap 106 will also be removed.

However, as previously mentioned, the inner cap 106 contains a means for gripping said inner cap 106 such that it may be manually be removed by the user. As those skilled in the art will appreciate, alternate embodiments of the top end 136 of the inner cap 106 may be constructed of other suitable materials such that the removable liner 108 may be readily adhered thereto.

When the container system 100 is configured for shipping or storing the contents of the cup and main container 112, 114, the removable liner 108 is attached to the lip 122 of the main container 102 and the upper portion 126 of the cup 104. A tab 140 formed on the liner 108 comprises a means for removing the liner 108 in the presently preferred embodiment.

Figure 2:
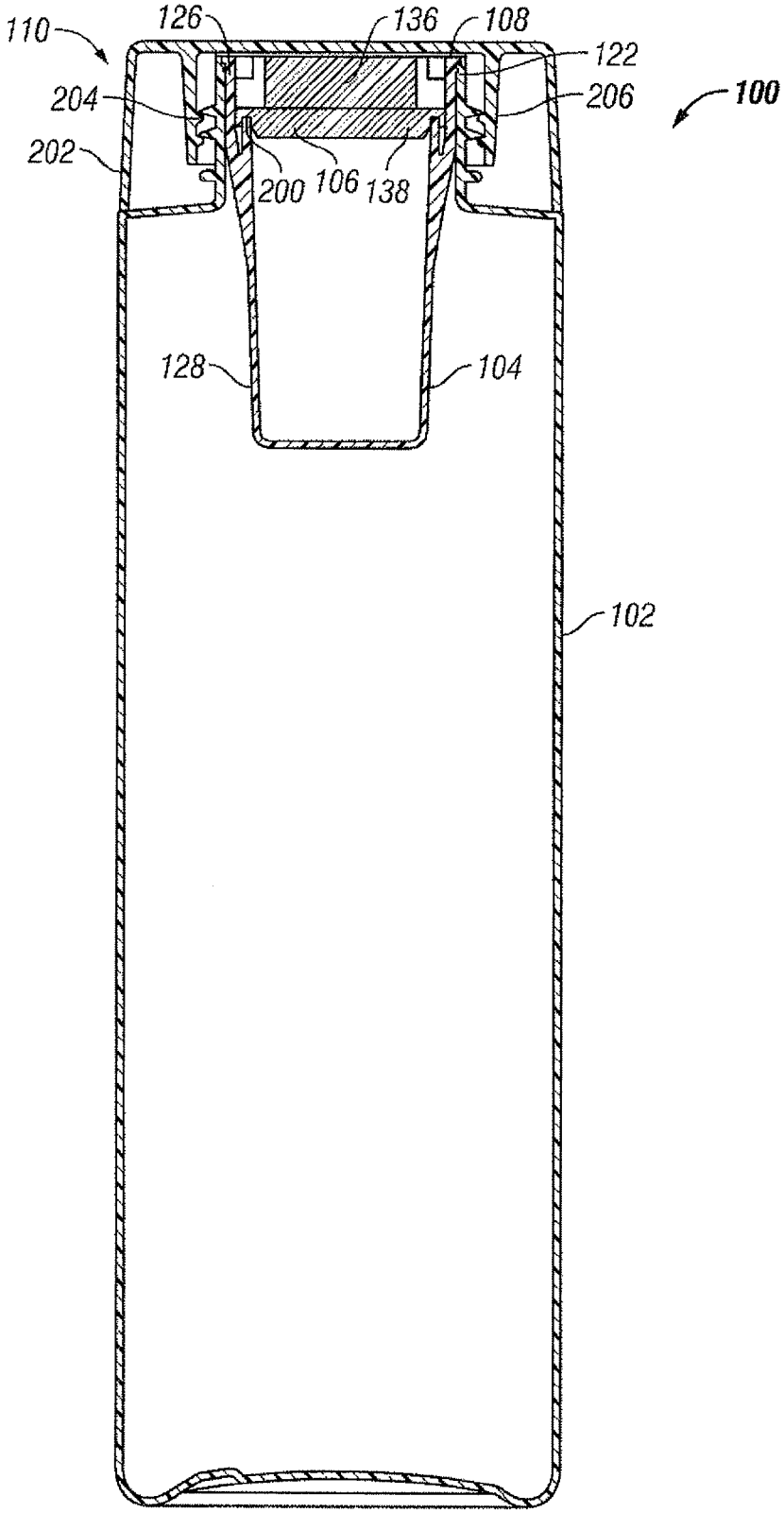
FIG. 2 is a cross-sectional view of the container system shown in FIG. 1.

Referring now to FIG. 2, a cross sectional view of a preferred embodiment of the container system 100. The upper portion 126 of the cup 104 is supported by the neck 116 of the main container 102. The outer cap 110 has outer walls 202 which may be utilized by the user to grip the cap 110, and threads 204 formed on inner walls 206 of the cap 110 which are adapted to engage the threads 120 formed along the outer surface of the neck 116. The inner surface of the top of the outer cap 110 is flush with the removable liner 108, thus aiding in sealing the main container 102 when properly secured to the neck 116. Like the top end of the inner cap 137, the outer cap 110 of the presently preferred embodiment is constructed of polypropylene, which is a material that may be easily adhered to by the removable liner 108. Those skilled in the art will appreciate that like the top end of the inner cap 137, the outer cap 110 may also be constructed of a material other than polypropylene provided that the material chosen is suitable for coupling with the removable liner 108. It should be understood that the removable liner 108 is not an essential element of the present invention and may be absent in alternate embodiments thereof.

Although the presently preferred embodiment of the invention utilizes corresponding threaded surfaces 120, 204 to removably secure the outer cap 110 to the main container 102, alternate embodiments may include any means for securing the outer cap 110 to said main container body 102. Likewise, alternate embodiments of the container system 100 may include other means for sealing the main container 102. One such alternate embodiment is further described below with reference to FIG. 7.

Figure 3:
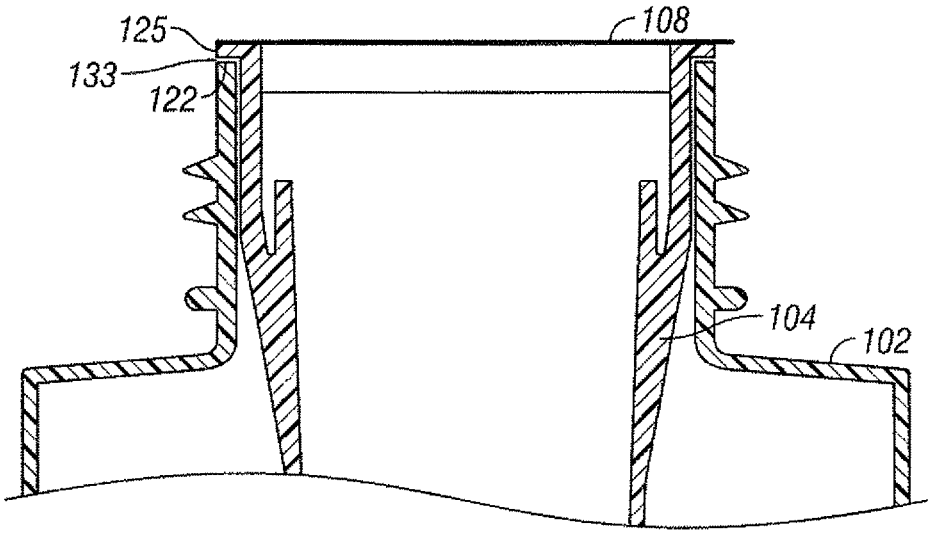
FIG. 3 is a cross-sectional view of the upper portion of the main container, the cup, and the removable liner of a prior art embodiment of a container system.
Figure 4:
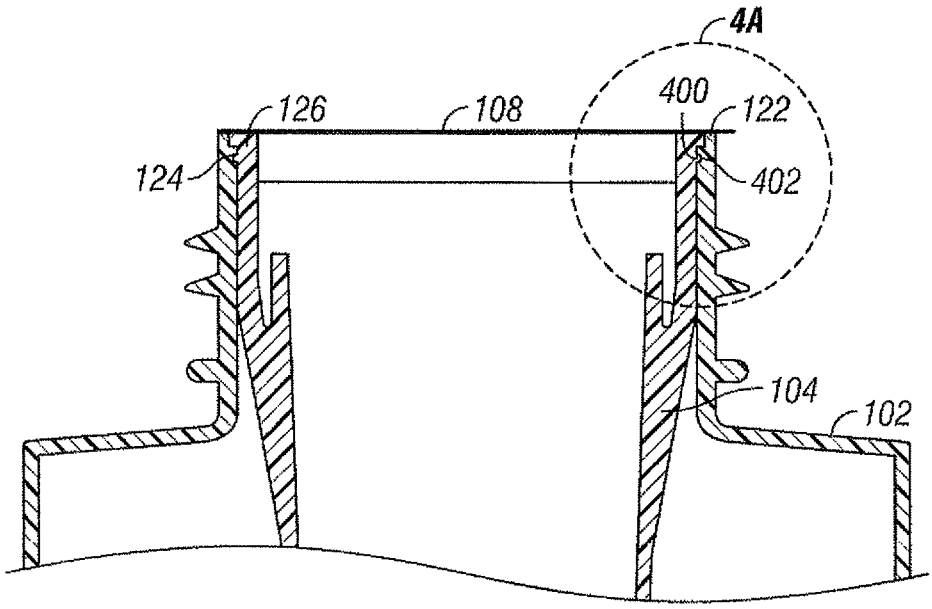
FIG. 4 is a cross sectional view of the upper portion of the main container, the cup, and the removable liner of the container system shown in FIG. 1.
Figure 4A:
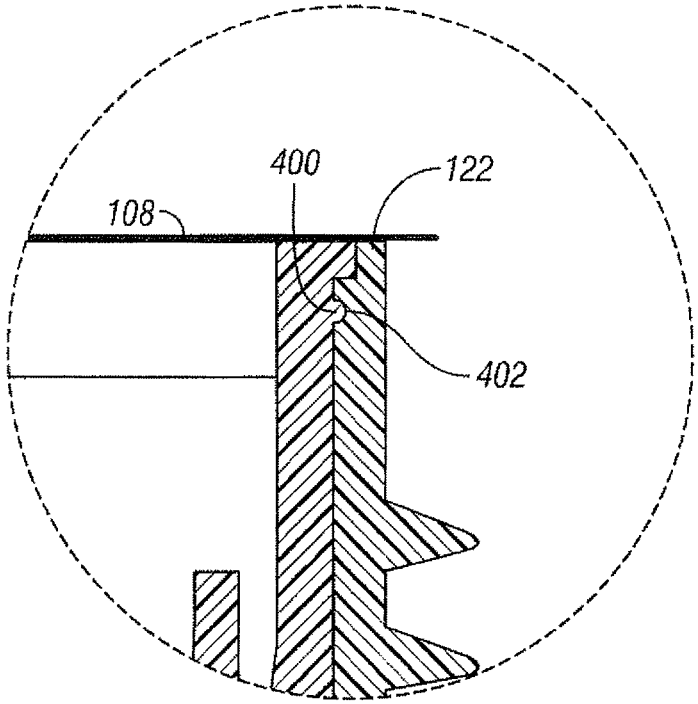
FIG. 4A is a zoomed-in view of the container system shown in FIG. 4, which more closely shows the manner in which the cup is removably secured to the neck of the main container body.
Figure 4B:
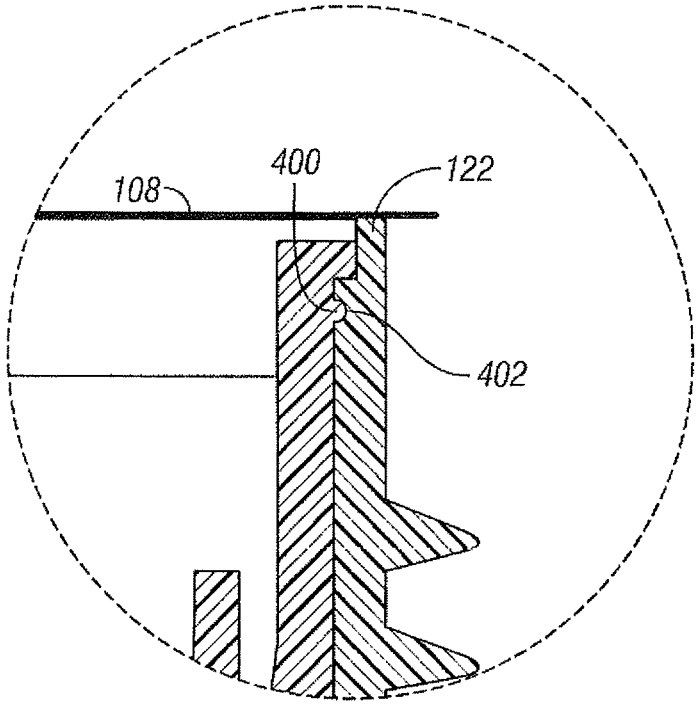
FIG. 4B is a zoomed-in view of an alternate embodiment of the cup and main container body shown in FIG. 4A.

Referring now to FIG. 3 and FIG. 4, cross-sectional views of the upper portions of the main container 102 and cup 104 of prior art container systems and the presently preferred embodiment respectively. The present invention provides an advantage over prior art container systems which include a cup 104 configured to rest on top of the lip 122 of the main container 102. In such prior art container systems (see FIG. 3), a small gap 133 exists between the upper portion 125 of the cup 104 and the lip 122 of the main container 102, thus allowing for the possibility that leakage may occur between said gap 133. Now also referring to FIG. 4A, the present invention does not suffer from this drawback as the upper surface of the upper portion 126 of the cup 104 is configured to be flush with the lip 122 of the main container 102. With reference to FIG. 4B, the upper portion 126 of the cup 104 may alternatively be supported on the shoulder 124 such that the upper portion is not flush with the lip 122. The upper portion 126 of the cup 104 is further configured such that a protrusion 400 formed therein, engages with an indentation 402 formed on the inner surface of the neck 116 adjacent to the lip 122, therefore further sealing the main container 102 and also securing the cup 104 to said main container 102.

Figure 5:
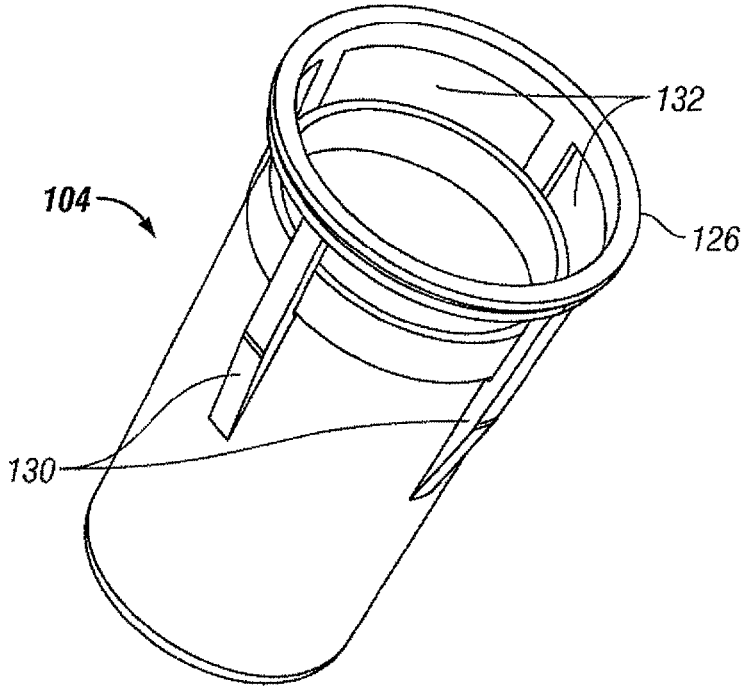
FIG. 5 is a first perspective view of a preferred embodiment of the cup shown in FIG. 1.
Figure 6:
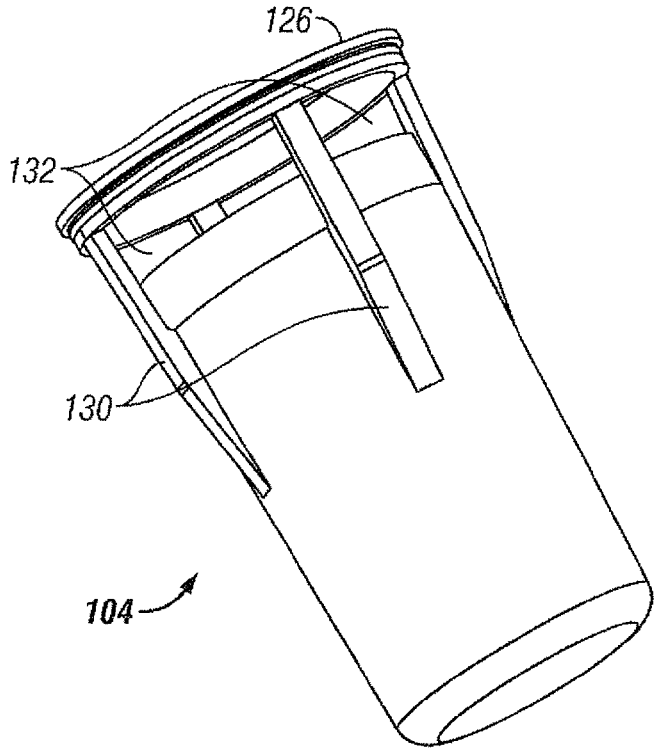
FIG. 6 is a second perspective view of a preferred embodiment of the cup shown in FIG. 1.

Referring now to FIG. 5 and FIG. 6, first and second perspective views of the preferred embodiment of the cup 104 of the present invention respectively. The distance between the upper portion 126 of the cup and the lower portion 128 of the cup 104 should be substantial enough to allow the first substance 112 of the cup 104 to easily mix with the second substance 114 via the apertures 132 between said upper 126 and lower portions 128 of the cup 104 during the mixing process. The presence of the apertures 132 through which the substances may mix provides an advantage not seen in the prior art in that the mixing process may occur without removing the cup 104 from the main container 102. Another advantage is that the mixing of the substances may occur without utilizing a void within the outer cap 110, thus eliminating sealing problems found in prior art container systems.

Figure 7:
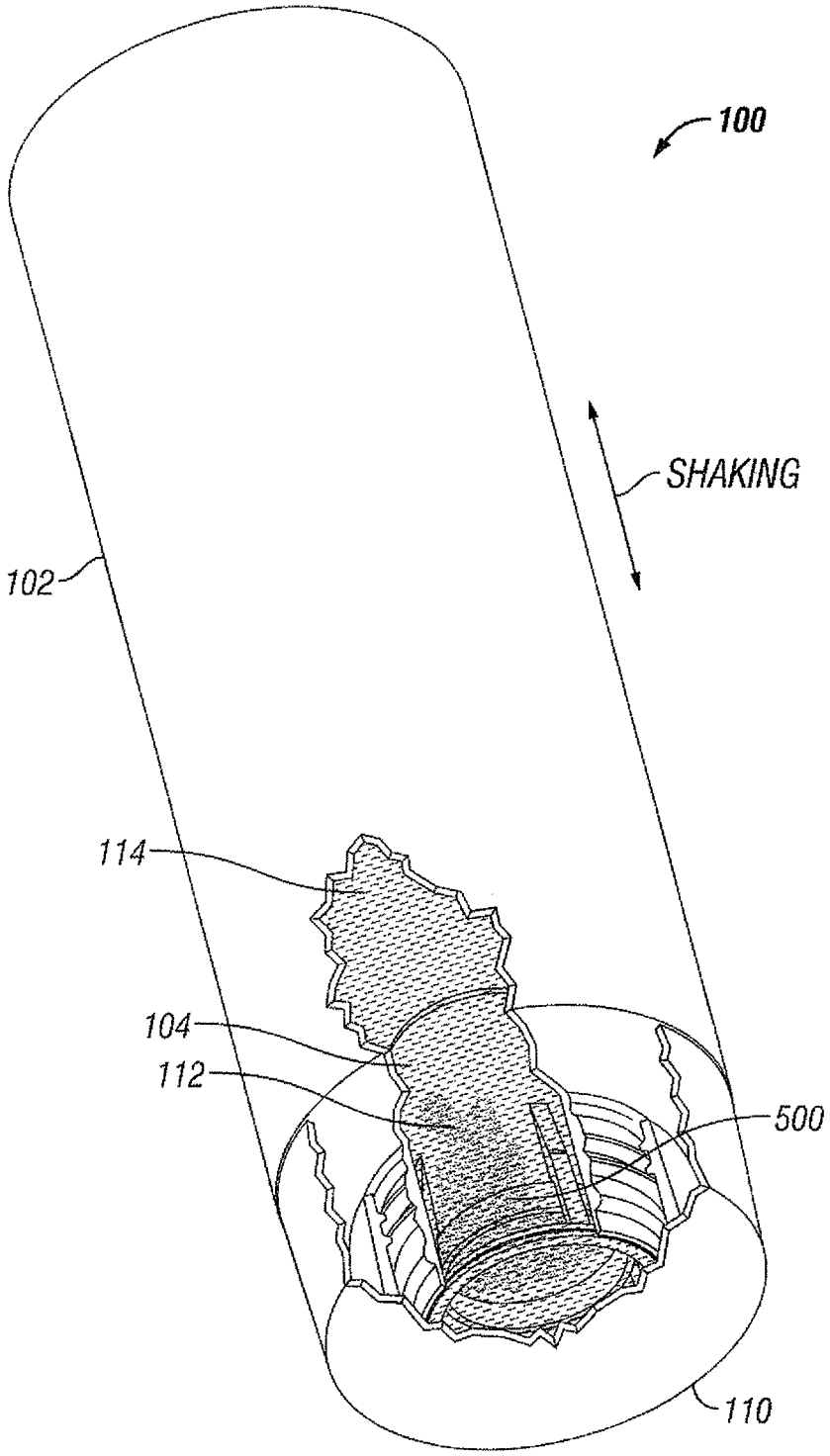
FIG. 7 shows a perspective view (including a "cut-away" view) of the container system of the present invention and a preferred manner of use thereof.

Referring now to FIG. 7, a cut-away perspective view of the container system 100 of the present invention and a preferred manner of use thereof. The present invention provides a structure allowing for a manner of mixing the first substance 112 with the second substance 114 held within the cup 104 and main container 102 respectively. Prior to mixing the substances, the outer cap 110 must initially be removed in order to allow the user to remove the liner 108 and the inner cap 106. The liner 108 may be optionally reattached to the lip 122 and upper portion 126 of the cup 104 to provide additional sealing capabilities. The outer cap 110 must then be re-secured to the neck 116 of the main container body 102. The container system 100 may be inverted and shaken by the user, thus allowing the first substance 112 to exit through the apertures 132 which exist between the upper portion 126 of the cup 104 and lower portion 128 of the cup 104. The contents of the cup 112 and the contents of the main container 114 thoroughly mix within the main container 102 and the cup 104. It should be noted that it is not essential that the main container 102 be inverted in order to mix the substances 112, 114. In fact, mixing of the substances 112, 114 will occur if the user chooses to merely agitate the main container 102.

Although parts of the upper portion 126 of the cup 104 abut the inner surface of the neck 116, a void 500 exists between the lower portion of the cup and the inner surface of the neck, allowing the contents 112, 114 to freely flow between the cup and the main container during the mixing process. The diameter of the lower portion 128 of the cup 104 is less than the diameter of the neck adjacent to said lower portion 128, such that the space therebetween defines said void 500. When said second substance 114 is in liquid form, a shaking motion by the user, imparted to the main container 102 will generate vortices (not shown) within said liquid, thereby promoting the mixing of said substances 112, 114. It should be noted that alternate embodiments of the container system 100 which contain two solid substances or two liquid substances may also be mixed in this manner, although said vortices are not substantially generated in said solid substances. However, solid substances may nevertheless be effectively mixed in the container system 100 of the present invention.

Figure 8:
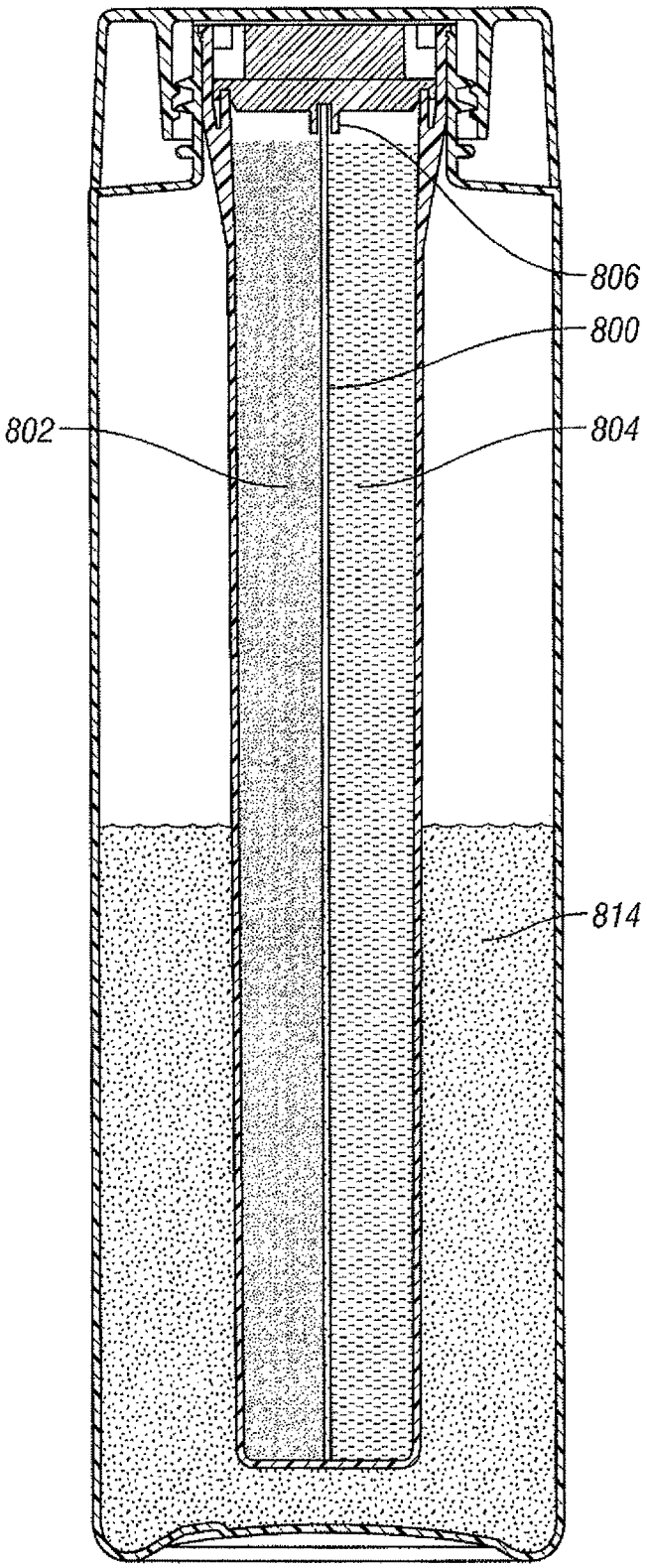
FIG. 8 shows a cross-sectional view of an alternate embodiment of the container system of the present invention.

Referring now to FIG. 8, which shows a cross-sectional view of an alternate embodiment of the container system 100 of the present invention. The lower portion of the cup is bifurcated with a wall 800 separating two different substances 802, 804 held within the cup. The bottom end 138 of the inner cap 106 contains a sealing notch 806, thus preventing the substances held within the cup from mixing prematurely. Furthermore, the lower portion 128 of the cup 104 is substantially longer than the cup of the presently preferred embodiment, thus allowing a greater volume of substances 112 to be stored therein.

Figure 9:
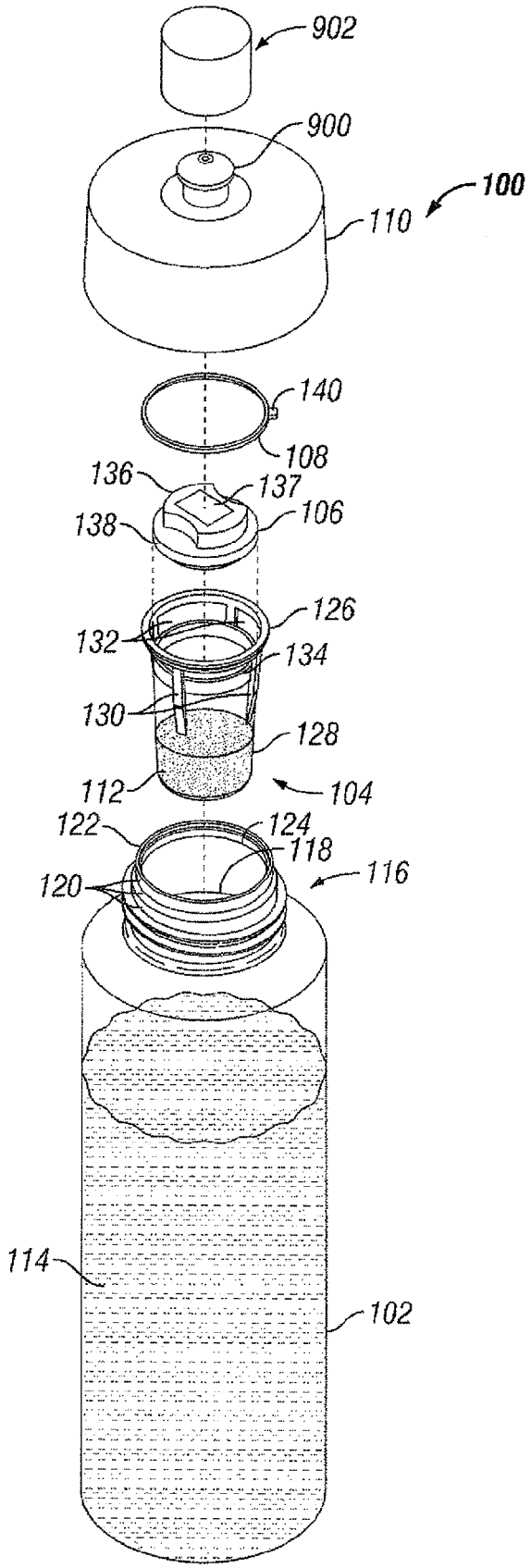
FIG. 9 shows an exploded perspective view of an alternate embodiment of the container system of the present invention.

Referring now to FIG. 9, which shows an exploded perspective view of an alternate embodiment of the container system 100 of the present invention. The outer cap of the alternate embodiment includes a nozzle 900 and nozzle cap 902. Nozzles 900 of the type shown are actuated into an open position by moving the nozzle 900 upwards relative to the outer cap 110. Such nozzles 900 are well known in the art. The nozzle 900 allows a user to drink from the main container 102 while the outer cap 110 remains secured to the neck 116. The nozzle cap 902 may be included in alternate embodiments of the present invention in order to further seal the nozzle 900 and keep the surface of said nozzle 900 free from dust or other undesirable substances.

Figure 10:
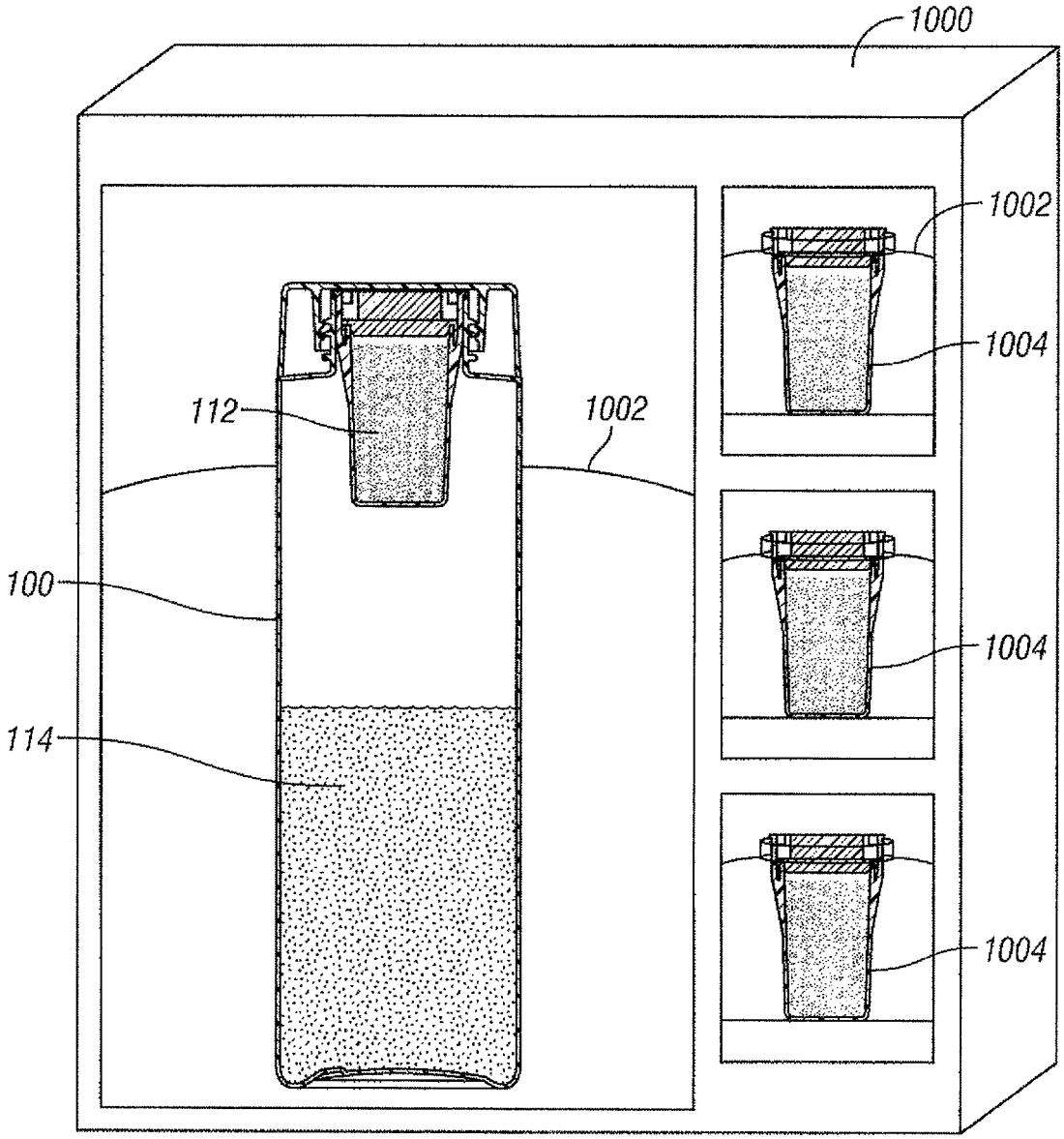
FIG. 10 shows a perspective view of a packaging system configured to contain the container system according to a preferred embodiment of the present invention.

Referring now to FIG. 10, a perspective view of a package 1000 for storing the container system 100 and cups 104 (with mixing substances) of the present invention. The package 1000 is partitioned such that one portion of the package 1000 holds at least one main container body 102 and outer cap 110, and individual cups 104. The individual cups 104 may contain substances for mixing 112, or may alternatively be empty. By packaging the cups 104 and container system 100 in this manner, a user may use the main container 102 multiple times. Furthermore, the user may be provided with multiple cups 104 containing pre-measured amounts of substances 112, thus maximizing user convenience while minimizing user costs. Both the container system 100 and each of the individual cups 104 are secured 1002 to the packaging system 1000. It is contemplated that the container system 100 and individual cups 104 may be secured within the package by any means.

It should be noted that the descriptions and embodiments disclosed herein are not exhaustive and are illustrative only. Many modifications and variations will be apparent to those of ordinary skill in the art. Accordingly, the protection sought herein is as set forth in the claims below.

What is claimed is:

1. A container system for mixing two or more substances comprising:

(a) a main container for holding one or more first substances, said main container including a neck which has a lip defining an upper opening, said neck including at least one inwardly extending shoulder formed adjacent to said lip;

(b) a removable liner attached to said lip;

(c) a cup for holding one or more second substances, said cup including an upper portion and a lower portion, said upper portion and said lower portion having one or more apertures formed therebetween;

(d) a first sealing means removably securable to said main container; and (e) a second sealing means removably securable to said cup;

wherein said cup is supported on said at least one inwardly extending shoulder;

wherein said neck and said lower portion have a void formed therebetween;

wherein during mixing, said one or more second substances and said one or more first substances flow through said apertures and said void.

2. The container system according to claim 1 wherein said first sealing means comprises an outer cap having an inner surface, said inner surface including a means for securing said outer cap to an outer surface of the neck.

3. The container system according to claim 2 wherein said outer cap further comprises a nozzle.

4. The container system according to claim 2 wherein at least a portion of said outer cap and at least a portion of said cup are composed of High Density Polyethylene.

5. The container system according to claim 1 wherein said second sealing means comprises an inner cap having a top end and a bottom end, the top end including a means for gripping said inner cap, said bottom end having a means for mounting on the lower portion of said cup.

6. The container system according to claim 5 wherein at least a portion of said top end is composed of polypropylene.

7. The container system according to claim 1 wherein said cup is removably supported on said at least one inwardly extending shoulder.

8. The container system according to claim 1 wherein said one or more second substances comprises a mixture containing at least one amino acid.

9. The container system according to claim 1 wherein said one or more second substances comprises a mixture containing creatine.

10. The container system according to claim 1 wherein said one or more second substances comprises a mixture containing caffeine.

11. The container system according to claim 1 wherein said one or more second substances comprises a mixture containing coffee.

12. The container system according to claim 1 wherein said one or more second substances comprises a mixture containing tea.

13. The container system according to claim 1 wherein at least one of said one or more second substances is dehydrated.

14. The container system according to claim 1 wherein said one or more first substances are preservative free.

15. A method of separately storing one or more first substances and one or more second substances such that said first substances and said second substances may be mixed, the method comprising the steps of:

(a) placing one or more first substances in a main container having a neck and a lip defining an upper opening, said neck including at least one inwardly extending shoulder formed adjacent to said lip;

(b) placing one or more second substances in a cup, said cup including an upper portion and a lower portion, said upper portion and said lower portion having one or more apertures formed therebetween, said cup being supported on said at least one inwardly extending shoulder, said neck and said lower portion having a void formed therebetween;

(c) providing a first sealing means that is securable to said cup and capable of being removed prior to mixing of said first and second substances;

(d) providing a removable liner that is attached to said lip; and (d) providing a second sealing means that is securable to said main container.

16. The method according to claim 15 wherein said one or more second substances comprises a mixture containing amino acids.

17. The method according to claim 15 wherein said one or more second substances comprises a mixture containing coffee.

18. The method according to claim 15 wherein said one or more second substances comprises a mixture containing tea.

19. The method according to claim 15 wherein said one or more second substances comprises a mixture containing creatine.

20. The method according to claim 15 wherein said one or more second substances comprises a mixture containing caffeine.

21. The method according to claim 15 wherein at least one of said one or more second substances is dehydrated.

* * * * *